US007048119B2

(12) United States Patent
Baechle

(10) Patent No.: US 7,048,119 B2
(45) Date of Patent: May 23, 2006

(54) BOTTOM LIFTING SEE-THROUGH BASELOID HANDLING PACKAGE FOR APPLIANCES

(75) Inventor: James Baechle, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 150 days.

(21) Appl. No.: 10/605,866

(22) Filed: Oct. 31, 2003

(65) Prior Publication Data

US 2005/0092634 A1 May 5, 2005

(51) Int. Cl.
*B65D 85/00* (2006.01)

(52) U.S. Cl. ..... 206/320; 206/586; 206/598

(58) Field of Classification Search ..... 206/320, 206/326, 453, 586, 595, 597, 598, 600; 229/199, 229/122.32

See application file for complete search history.

(56) References Cited

U.S. PATENT DOCUMENTS 2,972,440 A 2/1961 Munroe
3,029,994 A 4/1962 Chapman
3,616,986 A * 11/1971 Wolfe et al. ..... 206/320
3,891,086 A * 6/1975 Isaacs ..... 206/320
4,226,327 A * 10/1980 Ballard ..... 206/320
4,260,071 A * 4/1981 Bamburg et al. ..... 229/122.32
4,762,226 A * 8/1988 Gatton ..... 206/320
4,811,840 A 3/1989 Muyskens
5,161,692 A 11/1992 Knierim
5,249,678 A 10/1993 Traina
5,277,310 A 1/1994 Mertz
5,307,928 A 5/1994 Bishop
5,595,051 A 1/1997 Applegate
5,669,496 A 9/1997 Daniels
5,862,911 A 1/1999 Phillips, II et al.
6,155,419 A 12/2000 Sowa
6,357,587 B1 3/2002 Melms, Jr.
6,367,626 B1 * 4/2002 Muyskens ..... 206/320

* cited by examiner

*Primary Examiner*—David T. Fidei
(74) *Attorney, Agent, or Firm*—Clausen Miller, P.C.

(57) ABSTRACT

A bottom lifting see-through baseloid handling package for a major home appliance or similar product is provided. The package comprises a top cap, a bottom member and corner posts that form an enclosure having open sides to allow the product to be viewed. A plastic bag can be placed over the product and inside the bottom member and top cap. Since the baseloid handling flange is integrally formed in the bottom member, the packaged product is lifted from the bottom.

13 Claims, 4 Drawing Sheets

BOTTOM LIFTING SEE-THROUGH BASELOID HANDLING PACKAGE FOR APPLIANCES

BACKGROUND OF INVENTION

This patent relates to a package for large appliances. More particularly, this patent relates to a see-through package for irregular shaped major home appliances that can be lifted from the bottom with a baseloid lift truck.

Irregular shaped home appliances such as washers, dryers and stoves, in which a rear control console extends above the cabinet, are primarily packaged in six-sided corrugated cartons for two major reasons. First, the irregular shape makes it difficult to design packaging that transfers load through the product. Second, baseloid handling requirements for U.S. appliances make it difficult to design cartonless (transparent) packaging.

Six sided corrugated cartons (a.k.a. boxes) provide other benefits as well. They protect the appliance from damage during shipping and handling. They allow stacking of boxed appliances if sufficient structural support is provided, such as by inserting vertical support posts inside the box between the carton walls and the appliance.

One disadvantage of six sided corrugated cartons is that they do not allow easy viewing of the packaged appliance. Since it has become increasingly popular to display appliances in their original packaging, the lack of visibility afforded by six sided corrugated cartons is a serious shortcoming.

Packaged appliances, including those packaged in six sided corrugated cartons, are usually lifted and moved using either forklift trucks, clamp trucks or baseloid lift trucks. Forklift trucks lift the packaged appliance from the bottom and require some clearance between the package and the floor. Clamp trucks lift the appliance by applying clamp pressure to the sides of the package and require lateral support to prevent the package from being crushed. Baseloid lift trucks lift the appliance by a baseloid flap or flange typically located near the top rear of the appliance package as explained further below.

Baseloid lift trucks have a vertically oriented lift blade extending from a frame secured to an elevator mechanism mounted on the front end of the lift truck. To lift an appliance with a baseloid lift truck, the vertical blade is placed in flat contact with the rear wall of the packaged appliance. As the elevator mechanism raises the lift blade, the top edge of the blade extends into a crease between the side of the package and a downwardly extending flap, referred to as a baseloid flap. The lift blade is raised until a horizontal lifting bar mounted on the blade abuts the bottom edge of the baseloid flap. The appliance can then be lifted off the floor by the elevator mechanism and moved.

Because the baseloid flap is located at the top rear of the package, baseloid lifting causes the unit to tip forward slightly. When two (or more) stacked units are lifted the tendency to tip forward is even greater, which can cause the top unit to slide forward. As the weight of the top unit shifts forward, the front of the top cap on the bottom unit can bend or collapse downward as much as six inches, a phenomenon referred to as trapezoiding. As the front of the top cap deflects downward, the top unit can slide further forward and fall off.

One solution to the trapezoiding problem, particularly as it applies to see-through packages, was proposed in commonly owned Muyskens U.S. Pat. No. 6,367,626, which provides a package comprising a clamshell-like framework including a corrugated top cap, front and rear corner posts, two bottom members and a baseloid flange at the top of the unit. The framework is glued together prior to installing it over the appliance. After the framework has been placed around the appliance, and with the baseloid flange in an outwardly extended horizontal position, a transparent film may be stretch wrapped around the unit. When the wrapping is complete, the baseloid flange is folded down and a horizontal band is placed around the top cap and baseloid flange. The top cap includes side panels that extend diagonally downward from the baseloid flange in the rear to the corner posts in front. These side panels help prevent trapezoiding during baseloid lifting of stacked units by transferring the downward force of the top unit to the bottom of the package. The strength and integrity of the package is reliant on the front corner posts being glued to the top cap.

It is an object of the present invention to provide an alternative solution to the problem of providing a see-through package for irregular shaped appliances that resists trapezoiding when handled with a baseloid lift truck.

Another object of the present invention is to provide a see-through package that does not require gluing the corner posts to the top cap.

Still another object of the invention is to provide a package that can be lifted from the bottom by a baseloid lift truck.

Yet another object of the invention is to provide a package that allows a common baseloid blade height for appliances of different heights, thereby allowing warehouse drivers to pick up packaged appliances of different heights with the same baseloid height setting.

Yet another object is to provide a package that uses a plastic bag installed on the inside of the bottom and top caps to prevent the plastic from being torn by a baseloid lifting blade and to eliminate the need to have the plastic stretched or shrunk over the unit.

Further and additional objects will appear from the description, accompanying drawings, and appended claims.

SUMMARY OF INVENTION

The present invention is a bottom lifting see-through baseloid handling package for a product such as a major home appliance. The package comprises a top cap, a bottom member enclosing a bottom portion of the appliance and corner posts extending between the top cap and the bottom member and having upper ends fitted under the top cap and lower ends interposed between the product and the bottom member. The corner posts have substantially L-shaped cross-sectional profiles so that they fit snugly against the vertical edges of the appliance. The top cap, bottom member and corner posts form an enclosure having open sides that allows the product to be viewed. The package may include a horizontal retaining band urging the baseloid flange toward the rear panel and providing an additional means for holding the packaging assembly together.

In a key aspect of the invention, the bottom member comprises a rear panel having a top edge and a baseloid flange extending downward from the top edge for accommodating a baseloid lift blade. Where the appliance has a cabinet and a console extending above a top surface of the cabinet, the baseloid flange preferably is located lower than the cabinet top surface.

The package may also comprise a transparent bag draped over the appliance to protect it from dust and dirt. The bag is merely placed over the appliance (and within the top cap, corner posts and bottom member); there is no need to have the bag stretched or shrunk, which eliminates the need for a large capital expenditure for heat and/or stretch film equipment.

DETAILED DESCRIPTION

Figure 1:
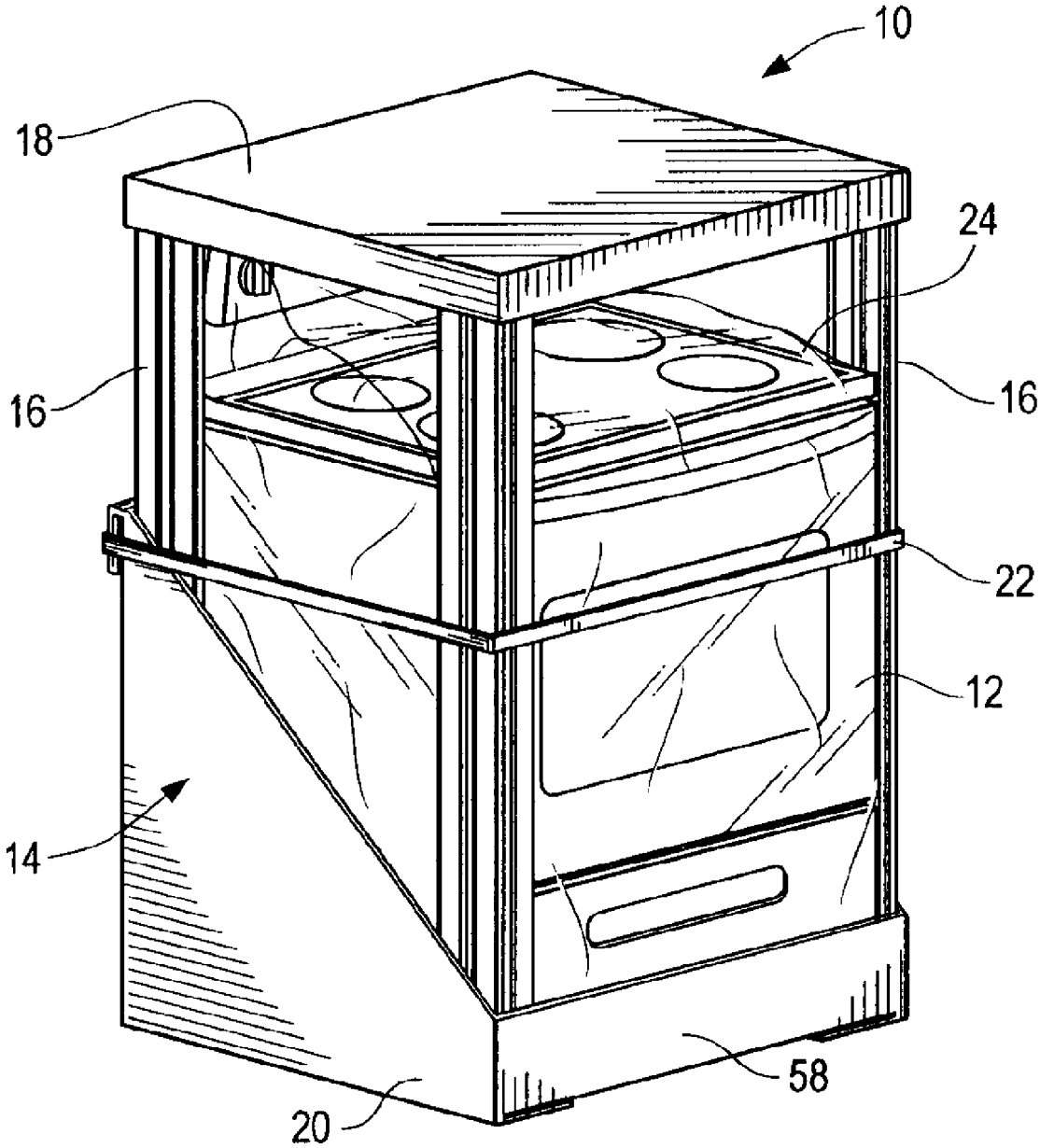
FIG. 1 is a perspective view of a packaged appliance according to the present invention.
Figure 3A:
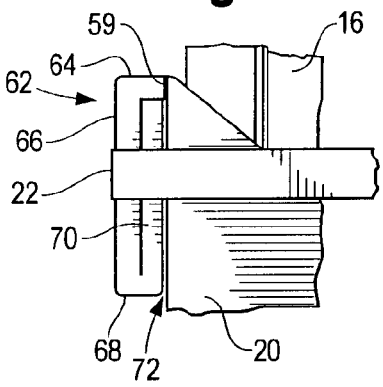
FIG. 3*a* is a partially enlarged view of the packaged appliance of FIG. 3 showing the baseloid handling flange.
Figure 3:
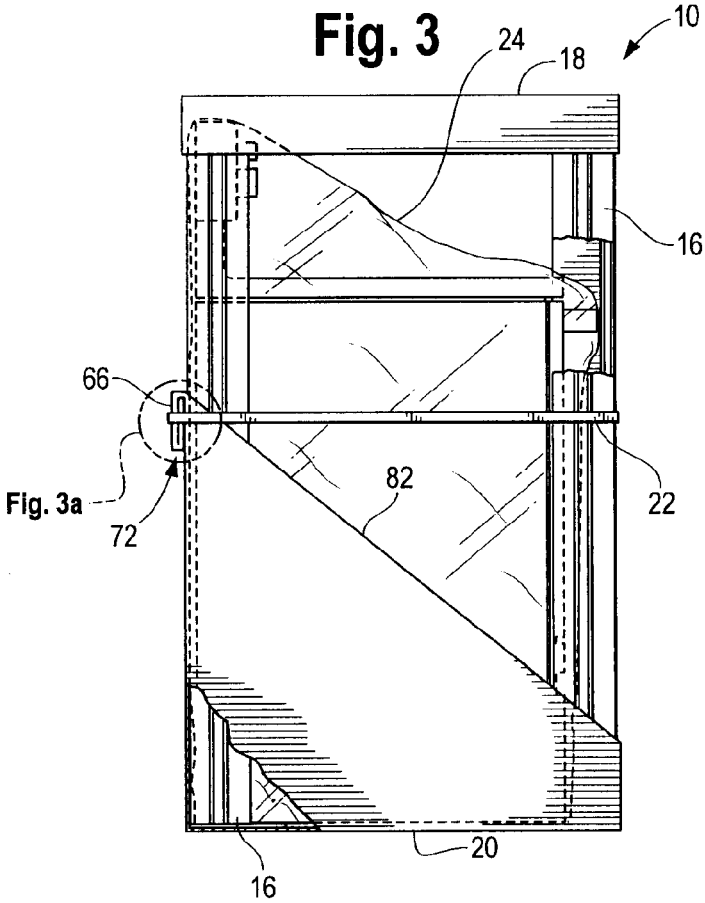
FIG. 3 is a side elevational view of the packaged appliance of FIG. 1.

Turning to the drawings, there is shown in FIGS. 1 and 3 a packaged appliance ("unit") 10 comprising a four-sided appliance 12 enclosed within a package 14 made according to a preferred embodiment of the invention. The package 14 allows easy viewing of the appliance 12, can be moved using a baseloid lift truck, and allows stacking of one unit 10 on top of another without trapezoiding.

Figure 2:
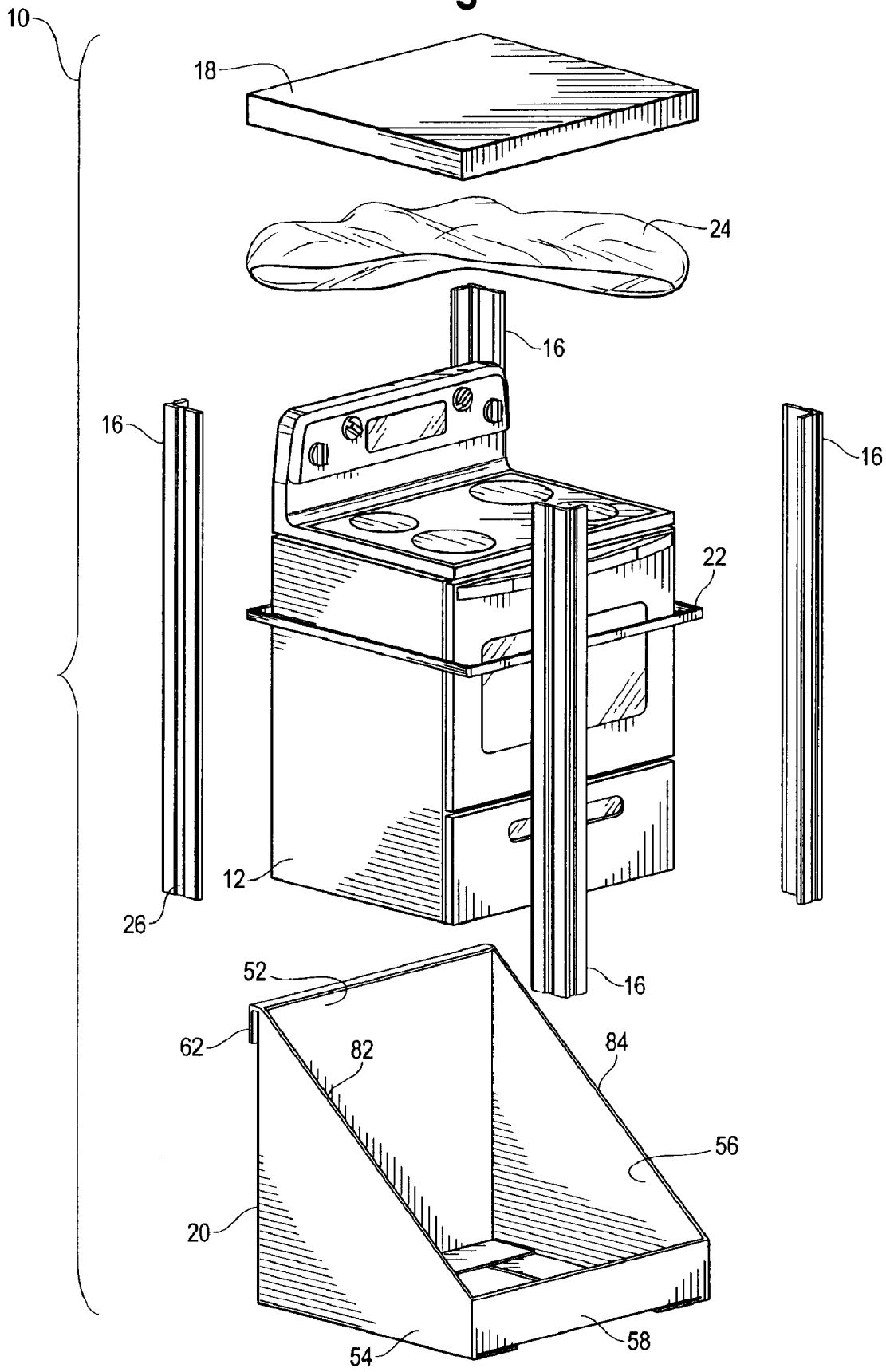
FIG. 2 is an exploded view of the packaged appliance of FIG. 1.

FIG. 2 is an exploded view of the packaged appliance 10 of FIG. 1. The appliance package 14 comprises four conventional fiberboard corner posts 16, a top cap 18, a bottom member 20, a horizontal retaining band 22 and a transparent plastic bag 24.

The corner posts 16 may be of the type manufactured by Sonoco Products Company of Hartsville, S.C. for the protection of large appliances, marketed under the registered trademark Sonopost® and protected by one or more of the following U.S. Pat. Nos. 4,482,054, 4,483,444, 5,267,651, 5,593,039 and 6,247,596, all of which are incorporated herein by reference. Such posts 16 are made from relatively inexpensive materials, yet exhibit high strength and stiffness. Alternatively, any suitable weight bearing corner posts may be used, including but not limited to folded corrugated paperboard corner posts, extruded plastic corner posts, metal reinforced corner posts, corner posts made of expanded polymeric materials (if suitably strong), and combination corrugated and laminated paperboard corner posts.

The posts 16 should have a substantially L-shaped cross-sectional profile to fit snugly against the vertical edges of the appliance 12 between the appliance 12 and the inside corners of the top cap 18 and bottom member 20. The posts 16 protect and cushion the appliance 12 and are load-bearing to allow units 10 to be stacked. A typical post 16 comprises a pair of spaced-apart walls joined at their respective ends to define a tube, with one or more full length beads or indentations 26 formed in the walls for additional stiffness, as described, for example, in Hughes U.S. Pat. No. 5,267,651.

The top cap 18 and the bottom member 20 preferably are formed from blanks of corrugated fiberboard, i.e., a blank having two flat outer paperboard sheets joined together by means of a corrugated or undulating paperboard sheet disposed between them, although other materials may be used for the blanks, including but not limited to solid fiberboard.

Figure 5:
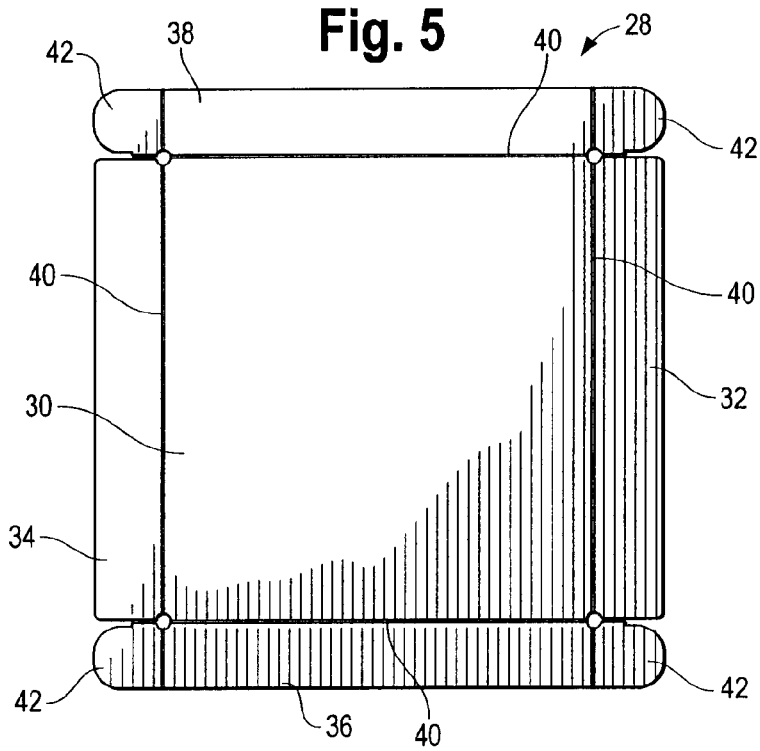
FIG. 5 is a plan view of a blank from which the top cap of the appliance package is formed according to the preferred embodiment of the invention.

The top cap 18 may be conventional in design and, as shown in FIG. 5, may be formed from a blank 28 comprising a center panel 30, side panels 32, 34 and front and rear panels 36, 38. The front, side and rear panels are joined to the center panel 30 along fold lines or score lines 40. (Hereinafter, including in the claims, "fold line" shall mean either a fold line or a score line or the equivalent thereof.) To assemble the top cap 18, the front, side and rear panels are folded downward along the fold lines 40 and the tab extensions 42 of the front and rear panels 36, 38 are glued or otherwise affixed to the side panels 32, 34. In the assembled top cap 18 the front, rear and side panels extend downward from the periphery of the center panel 30.

Figure 4:
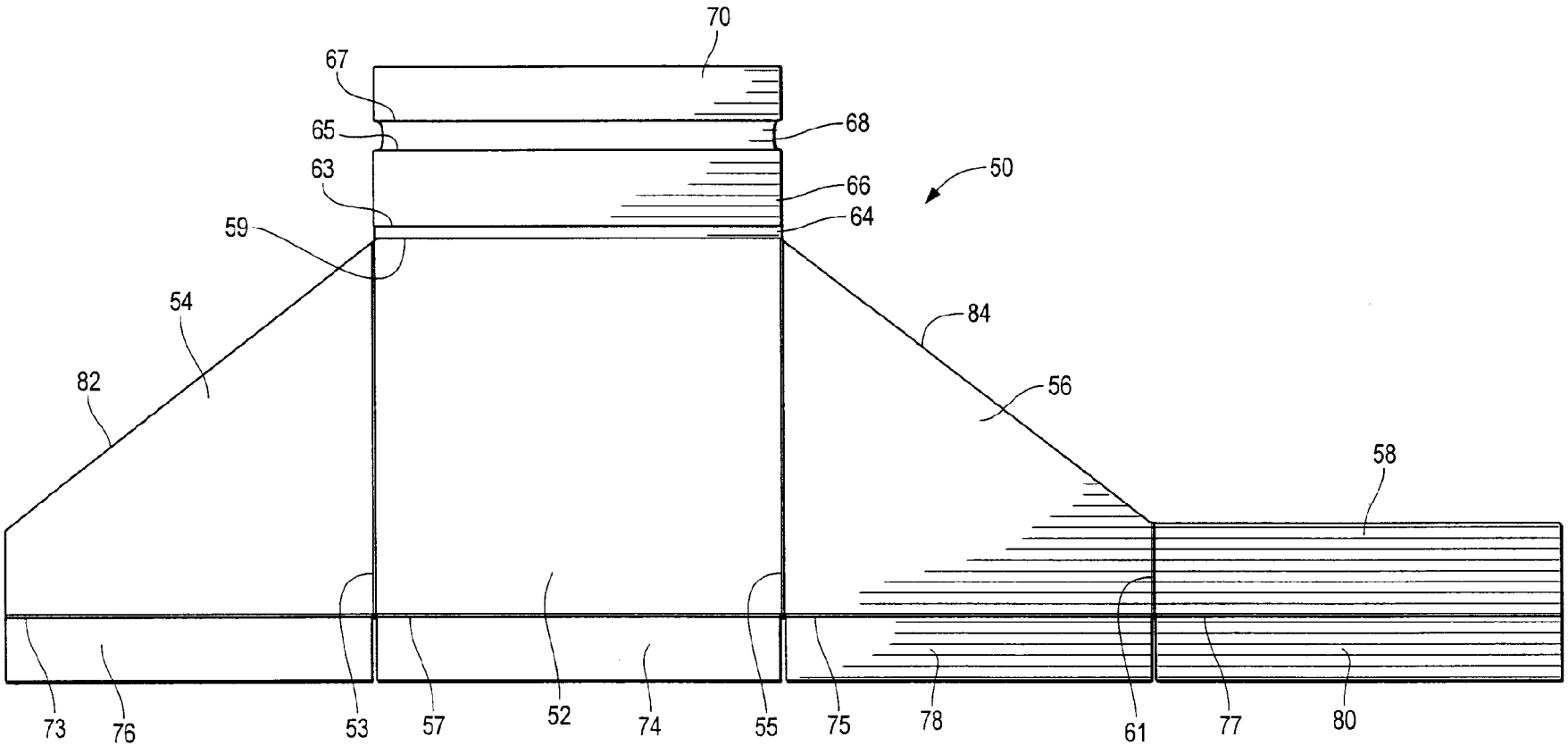
FIG. 4 is a plan view of a blank from which the bottom member of the appliance package is formed according to the preferred embodiment of the invention.

As shown in FIG. 4, the preferred bottom member 20 is formed from a corrugated blank 50 comprising a rear panel 52 defined by fold lines (side edges) 53, 55, fold line (bottom edge) 57, and upper rear fold line (top edge) 59. Two side panels 54, 56 are joined to the rear panel 52 along the respective opposing vertical fold lines 53 and 55. Each side panel 54, 56 preferably is shaped like a trapezoid having two right angles. A front panel 58, relatively shorter than the rear panel 52, is joined to a side panel 56 along a lateral fold line 61.

The bottom blank 50 includes four bottom flaps 74, 76, 78, 80 that fold in to form the bottom or base of the package 14. One bottom flap 74 is joined to the rear panel 52 along a fold line 57. Two other bottom flaps 76, 78 are joined to the side panels 54, 56 along fold lines 73, 75, respectively. A fourth bottom flap 80 is joined to the front panel 58 along a fold line 77.

A baseloid handling flange 62 (FIG. 3) extends about four inches downward from the top edge 59 of the rear panel 52. Referring again to FIG. 4, the baseloid flange 62 comprises a shallow upper edge panel 64 joined to the rear panel 52 by fold line 59, an outer panel 66 joined to the upper edge panel 64 at fold line 63, a lower edge panel 68 joined to the outer panel 66 at fold line 65, and an inner panel 70 joined to the lower edge panel 68 at fold line 67.

As perhaps best shown in FIG. 3*a*, to form the baseloid flange 62 from the blank 50, the upper edge panel 64 is bent about ninety degrees outward (forward) from the plane of the rear panel 52 so that it extends horizontally from the rear panel 52, the outer panel 66 is bent downward ninety degrees with respect to the upper edge panel 64, the lower edge panel 68 is bent ninety degrees inward (forward) so that it is substantially parallel to the upper edge panel 64, and the inner panel 70 in bent ninety degrees upward so that it is adjacent to the outer panel 66 and sandwiched between the outer panel 66 and the rear panel 52. The basiloid flange 62 may comprise additional folded panels for extra strength. The baseloid flange 62 is held in place by the retaining band 22 which is tightly wrapped around the bottom member 20 and the corner posts 16 at the level of the flange 62.

The purpose of the baseloid flange 62 is to accommodate the baseloid lifting blade of a baseloid fork lift truck. The baseloid lifting blade (not shown) is inserted into the slot 72 between the baseloid flange 62 and the rear panel 52. The baseloid flange 62 is two corrugated fiberboard layers thick and has a lower edge panel 68 that bears the lifting force of the baseloid blade. The baseloid blade should be slightly shorter than the length of the slot 72 so that when fully inserted into the slot 72 the top edge of the blade does not pierce top edge panel 64 of the baseloid flange 62.

When fully inserted, a horizontal bar mounted on the baseloid blade abuts the lower edge panel 68 of the baseloid flange 52 to lift the unit 10. The retaining band 22 keeps the baseloid flange 62 in position during lifting.

Significantly, the unit 10 is lifted by the bottom member 20 and thus nearer the bottom than in previous packages in which the unit was lifted by the top cap. Lifting the unit 10 from nearer the bottom minimizes the tendency of the unit 10 to tip forward and prevents trapezoiding. Where the packaged product 14 is an irregular shaped appliance (i.e., an appliance having a substantially rectilinear cabinet and a control console extending above the cabinet), the baseloid handling flange 62 preferably is located below the top of the appliance cabinet.

To assemble the bottom member 20, the side panels 54, 56 are folded forward ninety degrees with respect to the rear panel 52 along fold lines 53, 55 and the front panel 58 is folded ninety degrees with respect to the side panel 56 along fold line 61 until it is square with (parallel to) the rear panel 52. The bottom flaps 74, 76, 78, 80 are folded ninety degrees along their respective fold lines 57, 73, 75, 77 to form the bottom or base of the package and they may be glued, stapled or otherwise affixed to each other. The baseloid flange 62 is assembled as described above. When the bottom member 20 is assembled, the top edges 82, 84 of the side panels 54, 56 extend diagonally downward from the top edge 59 of the rear panel 52 to the front panel 58, maximizing the visible surface of the appliance 12.

To assemble the unit 10 (appliance 12 plus package 14), the transparent bag 24 is first draped over the appliance 12, which may be resting on and affixed to a base pad. The base pad (not shown) may be any type of base pad, including but not limited to conventional wooden base pads or composite base pads such as that described in co-owned U.S. Pat. No. 6,155,527, incorporated herein by reference. Next, the bottom member 20 is placed over the appliance 12 and the bottom flaps 74, 76, 78, 80 are folded and glued under the base pad. The corner posts 16 are then inserted between the appliance vertical edges and the inside corners of the bottom member 20. The corner posts 16 may be inserted into openings in the optional base pad if so provided. The top cap 18 is fitted over the upper ends of the corner posts 16 and may be, but need not be, glued, stapled or otherwise affixed to the corner posts 16. Lastly, the retaining band 22 is placed around the packaged appliance to secure the baseloid flange 62 to complete the package 14.

Thus there has been described a package 14 for an irregular shaped major home appliance 12 or similar product that can be lifted by the bottom member 20 with a baseloid lift truck. The package 14 comprises a top cap 18, a bottom member 20 and corner posts 16 that form an enclosure having open sides to allow the product to be viewed. A bag 24, preferably made of transparent plastic, can be placed over the product 12 and within the bottom member 20 and top cap 18, thus preventing the bag 24 from being torn or snagged during handling. The use of a bag 24 instead of plastic film or wrap eliminates the need to have the bag 24 stretched or shrunk over the unit and eliminates the need for a large capital expenditure for heat and/or stretch film equipment.

The package 14 is strong enough to withstand the weight of one or more additional units stacked on top because the weight of the upper unit(s) is borne by the corner posts 16. The corner posts 16 fit within the top cap 18 without gluing so the integrity of the package 12 is not reliant on a glue bond between the corner posts 16 and the top cap 18.

Perhaps most significantly, the unit 10 is lifted by the bottom member 20 (below the top of the appliance cabinet in the case of irregular shaped appliances), instead of at the top as in previous designs. This arrangement has at least two advantages. First, it increases handling stability by reducing the tendency of the unit 10 to tilt forward when lifted, particularly when one or more additional units are stacked on top. Second, it allows a common baseloid height regardless of the height of the appliance 12, which in turn allows baseloid lift truck drivers to pick up any unit 10 with the same baseloid height setting.

Other modifications and alternative embodiments of the invention are contemplated which do not depart from the scope of the invention as defined by the foregoing teachings and appended claims. It is intended that the claims cover all such modifications that fall within their scope.

What is claimed is:

1. A bottom lifting baseloid handling package for holding a four-sided product, the package comprising:

a bottom member for enclosing a bottom portion of the product, the bottom member comprising a rear panel adjacent a side of the product and having a top edge and a baseloid flange extending downward from the top edge of the rear panel for accommodating a baseloid lift blade, side panels extending perpendicularly forward from the rear panel, and a front panel extending perpendicularly from the side panels;

wherein each bottom member side panel has a top edge extending diagonally downward from the top edge of the rear panel to the front panel.

2. The package of claim 1 wherein each side panel is trapezoidal.

3. The package of claim 1 wherein the bottom member further comprises a plurality of bottom flaps that extend under the product to form a package bottom.

4. The package of claim 3 wherein one bottom flap is joined to a lower edge of the rear panel, opposing bottom flaps are joined to lower edges of the side panels, and fourth bottom flap is joined to a lower edge of the front panel.

5. The package of claim 1 wherein the baseloid flange comprises an upper edge panel extending substantially horizontally from the rear panel, an outer panel extending vertically downward from the upper edge panel, a lower edge panel extending horizontally inward from the outer panel, and an inner panel extending vertically upward so that it is adjacent to the outer panel and interposed between the outer panel and the rear panel.

6. The package of claim 1 wherein the bottom member is formed from corrugated board.

7. The package of claim 1 wherein the bottom member is formed from solid fiberboard.

8. The package of claim 1 further comprising:

a top cap; and corner posts extending vertically between the top cap and the bottom member and having upper ends fitted under the top cap and lower ends interposed between the product and the bottom member.

9. The package of claim 8 wherein the top cap, bottom member and corner posts form an enclosure having open sides that allow the packaged product to be viewed.

10. The package of claim 8 further comprising a transparent bag draped over the product.

11. The package of claim 8 further comprising a horizontal retaining band urging the baseloid flange toward the rear panel.

12. The package of claim 8 wherein the top cap comprises a center panel and front, rear and side panels extending downward from the periphery of the center panel.

13. A package for a large household appliance having a cabinet with a top surface, the package comprising:

a bottom member for enclosing a bottom portion of the appliance, the bottom member comprising an upwardly extending rear panel terminating in a top edge located below the top of the appliance cabinet; and a baseloid flange extending downward from the rear panel top edge for accommodating a baseloid lift blade;

wherein the bottom member further comprises side panels, each side panel extending forward from the rear panel to a front edge and having a top edge that extends diagonally downward from the rear panel top edge to a front corner, thereby exposing part of the appliance, and a front panel extending between the side panel front edges.

* * * * *